US006520500B2

(12) United States Patent
Pierce et al.

(10) Patent No.: US 6,520,500 B2
(45) Date of Patent: Feb. 18, 2003

(54) MULTI-PLAYFIELD REDEMPTION GAME

(76) Inventors: Jeffrey Pierce, 1031 S. Beloit, Forest Park, IL (US) 60130; Lyle Willimann, 430 D James Ct., Glendale Heights, IL (US) 60139

( * ) Notice: Subject to any disclaimer, the term of this patent is extended or adjusted under 35 U.S.C. 154(b) by 0 days.

(21) Appl. No.: 09/995,944

(22) Filed: Nov. 28, 2001

(65) Prior Publication Data

US 2002/0079646 A1 Jun. 27, 2002

Related U.S. Application Data

(60) Provisional application No. 60/253,854, filed on Nov. 29, 2000.

(51) Int. Cl.[7] ..... A63F 7/00

(52) U.S. Cl. ..... 273/108; 273/126 R; 273/440

(58) Field of Search ..... 273/108, 118 R, 273/119 R, 121 R, 129 R, 126 R, 440, 454, 459, 460

(56) References Cited

U.S. PATENT DOCUMENTS

| | | | | |
|---|---|---|---|---|
| 4,303,248 A | | 12/1981 | Shoemaker, Jr. et al. | |
| 4,840,375 A | * | 6/1989 | Lawlor et al. | 273/119 A |
| 5,275,402 A | | 1/1994 | Malavazos et al. | |
| 5,445,138 A | | 8/1995 | Faith | |
| 5,511,794 A | | 4/1996 | Katamoto | |
| 5,632,482 A | * | 5/1997 | Anghelo | 273/118 R |
| 5,667,217 A | | 9/1997 | Kelly et al. | |
| 5,676,371 A | | 10/1997 | Kelly et al. | |
| 5,741,010 A | * | 4/1998 | Weyna | 273/118 A |
| 5,743,523 A | | 4/1998 | Kelly et al. | |
| 5,839,723 A | | 11/1998 | Grimes | |
| 5,888,115 A | | 3/1999 | Shoemaker, Jr. et al. | |
| 5,967,515 A | | 10/1999 | Halliburton | |
| 5,967,892 A | | 10/1999 | Shoemaker, Jr. | |
| 6,095,519 A | | 8/2000 | Shoemaker, Jr. | |

OTHER PUBLICATIONS

PCT International Search Report for International Application No. PCT/US01/45128.

* cited by examiner

*Primary Examiner*—Raleigh W. Chlu
(74) *Attorney, Agent, or Firm*—Welsh & Katz, Ltd.

(57) ABSTRACT

The game apparatus has a gamepiece aiming device having a plurality of degrees of movement that allows a player to have better aiming capability. The game apparatus features a multi-playfield game having at least first and second playfields that are coupled to one another. The gamepiece aiming device emits a gamepiece into the first playfield for first game play, the gamepiece thereafter being conducted to the second playfield for second game play. The gamepiece aiming device has a first degree of movement that is a substantially linear movement, and a second degree of movement that is a substantially rotational movement. In general, the playfield has a plurality of playfields and a plurality of levels, at least one respective playfield being in each level of the plurality of levels. Each playfield has a win/lose scenario, and the win/lose scenarios are independent of one another. Redemption tickets can be dispensed based on results of the win/lose scenarios.

30 Claims, 7 Drawing Sheets

MULTI-PLAYFIELD REDEMPTION GAME

CROSS-REFERENCE TO RELATED APPLICATIONS

This application claims the benefit of U.S. Provisional Application No. 60/253,854 filed Nov. 29, 2000.

FIELD OF THE INVENTION

The present invention relates in general to arcade games, and in particular, to coin or token redemption games.

BACKGROUND OF THE INVENTION

Numerous types of arcade games are known in the prior art. Roll-down games are popular games in arcades and utilize a ramp and a gamepiece, such as a coin, that is directed down the ramp. The coin, for example, is directed onto or into targets or around obstacles, and a game score is accumulated based on hitting or landing on the targets.

U.S. Pat. No. 5,667,217 discloses a roll-down arcade game that has an inclined playing surface and a coin directing mechanism. A player can direct a coin in a desired direction down the playing surface using the directing mechanism. The coin rolls toward one or more targets on the playing surface, and a game score is adjusted based on the target that receives the coin.

Such games only provide one game play per coin. Also, the player has limited aiming ability with regards to propelling the coin onto the playing surface. Furthermore, these arcade games have a limited lifetime, because players lose interest in playing the game.

Therefore, there is a need in the prior art for an arcade game that provides more than one game play for a single coin or token, as well as, an aiming device that allows the player to be more accurate in aiming the coin. There is a further need in the prior art for an arcade game that has a longer lifetime by sustaining the players' interest by providing new game play.

BRIEF SUMMARY OF THE INVENTION

The game apparatus of the present invention has a gamepiece aiming device having a plurality of degrees of movement that allows a player to have better aiming capability. The inventive game apparatus features a multi-playfield game having at least first and second playfields that are coupled to one another. The gamepiece aiming device emits a gamepiece into the first playfield for first game play, the gamepiece thereafter being conducted to the second playfield for second game play.

The gamepiece aiming device has a first degree of movement, of a plurality of degrees of movement, that is a substantially linear movement, and a second degree of movement, of the plurality of degrees of movement, that is a rotational movement. The playfield has a plurality of playfields and a plurality of levels, at least one respective playfield being in each level of the plurality of levels. Each playfield has a win/lose scenario, the win/lose scenarios being independent of one another.

In one embodiment the present invention is a multilevel game apparatus, in which the gamepiece aiming device has a gamepiece ejection device configure to have at least a rotational movement, and a carriage that supports the gamepiece ejection device, the carriage configured to have a linear movement. The game apparatus has a multi-playfield game having at least first and second levels, and having at least first and second playfields that are coupled to one another, the first playfield located in the first level and the second playfield located in the second level. The gamepiece aiming device emits a gamepiece into the first playfield for first game play on the first level, the gamepiece thereafter being conducted to the second playfield for second game play on the second level.

In another embodiment the present invention is a game system, which has a plurality of modular playfields. The game system has a multi-playfield game that has removeably coupled thereto a number of playfields that is a subset of the plurality of modular playfields, each of the playfields in the game device being successively traversed by a gamepiece, and each of the playfields in the game device having a respective win/lose scenario. Each playfield is coupled to a following playfield except for a last playfield in the game device. Each playfield is played irrespective of an outcome of a win/lose scenario of a previous playfield, and playfields in the game device are interchangeable with other playfields of the plurality of modular playfields.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DETAILED DESCRIPTION OF THE INVENTION

The present invention is a game apparatus or amusement machine having a unique coin mechanism assembly for use in arcade games of skill. The assembly is a gamepiece aiming device that uses more than one degree of movement allowing the player to have a higher degree of accuracy. With the ability to move the gamepiece aiming device side to side, the player is able to line up the entire assembly with the target prior to inserting the coin. In addition the player can also use the pivot option to make fine adjustments in aiming. For the arcade owner of the inventive game apparatus, the coin mechanism also allows for user inaccuracy, thereby increasing the player challenge and level of difficulty.

This sliding, rotating and/or swiveling coin aiming device of the present invention will aim and eject coins onto a downward slanting clear-viewing upper first playfield whereby coins are rolled toward moving lit targets and then drop onto a second playfield of a coin pusher, or other game device which periodically disturbs coins distributed thereon. The novel game apparatus incorporates two playfields or games in a single game cabinet. The player actives both games by insertion of a coin, for example, and gets two plays as one challenge.

The amusement machine of the present invention has the ability to have various interchangeable and compatible components from manufacture produced kits. With these kits the arcade game of skill is easily and quickly transformed into a completely different game. The majority of the game cabinet remains the same, but the internal components such as software, graphics, and specific game hardware are easily interchangeable. With the multi-playfield concept on different levels, the arcade owner has the ability to combine any combination of games offered. If an arcade owner decides to change the game after initial purchase, an upgrade kit from the manufacture will do that. The cabinet assembly including the display boards, circuit board, coin mechanism, ticket mechanism, lighting, glass, cabinet, and other hardware remain the same. Thus the arcade owner can continuously upgrade and change the game at minimal cost.

Figure 1:
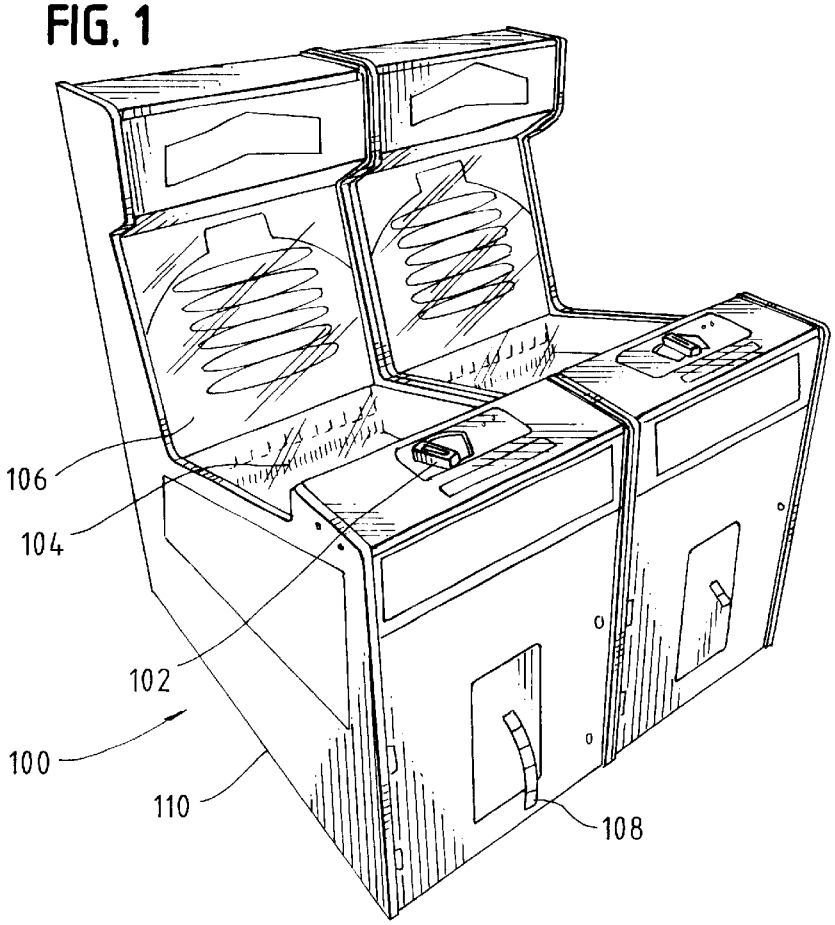
FIG. 1 is a perspective view of the game apparatus of the present invention.

In one embodiment depicted in FIG. 1, the present invention is a multilevel redemption game 100. The game 100 has a gamepiece aiming device 102, a multi-playfield game 104, and a score display 106, each of which is contained in a cabinet 110. A redemption game is a game of skill where a player inserts a token or coin, and through the use of eternal controls directs the token to a set of predetermined targets. Upon achieving the targets, a player will be awarded tickets 108. The tickets 108 may be redeemed for prizes.

Figure 2:
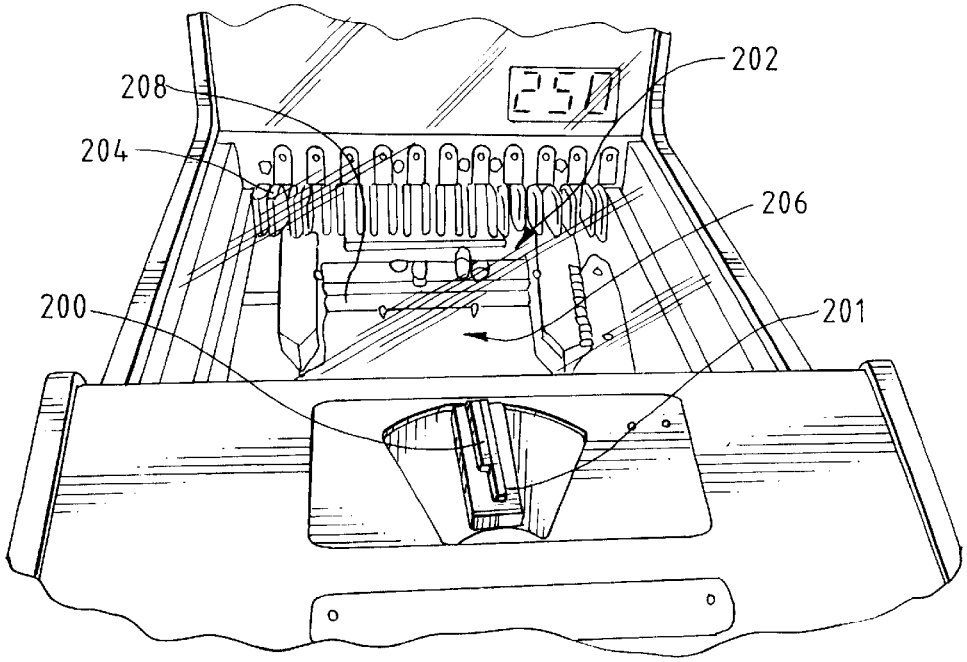
FIG. 2 is another view of the game apparatus of the present invention.

As depicted in FIG. 2 the multi-playfield game proceeds on two layers. In this embodiment a first layer has a first playfield 202. For the uppermost first layer the target is a series of slots 204. A lamp indicates which slot 204 is active and will generate additional tickets if the player can direct an inserted coin into the active slot 204. A coin mechanism slide or gamepiece aiming device 200 allows a player to direct the inserted coin towards an active slot 204. The coin is inserted into a gamepiece receiving mechanism 201. Such gamepiece or coin mechanisms are well known in the art.

Once the coin has been directed towards a slot 204 on the first playfield 202 of the first layer, the token will fall towards a second playfield 208 of a second layer where additional tickets may be generated. In the second layer additional tickets will be awarded if the inserted coin can cause additional existing coins to fall off the lower second layer. Such a game is known as a coin pusher in the art.

Figure 3:
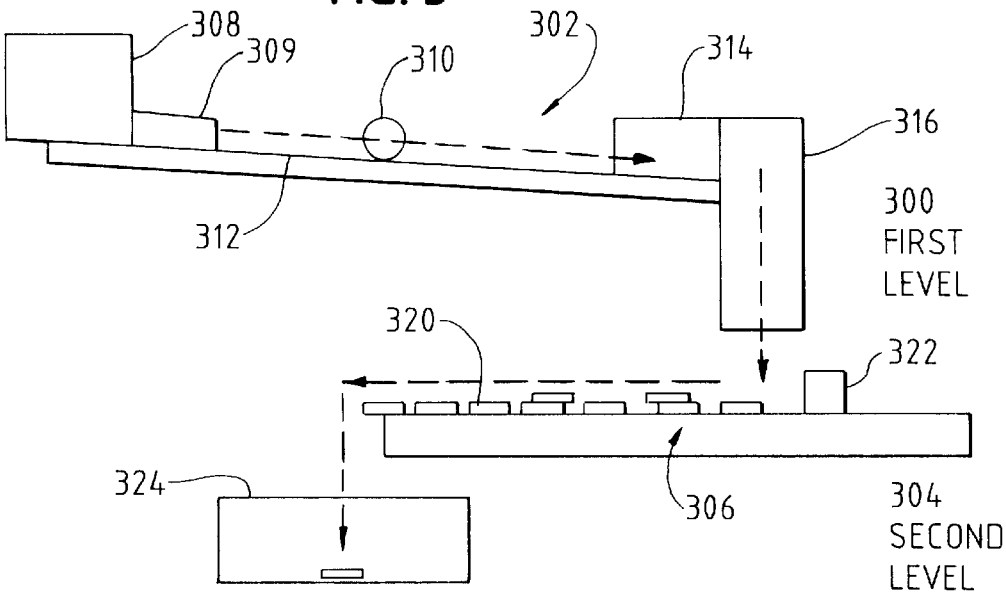
FIG. 3 is a side view of a diagram depicting the multiple levels of the inventive game apparatus.
Figure 4:
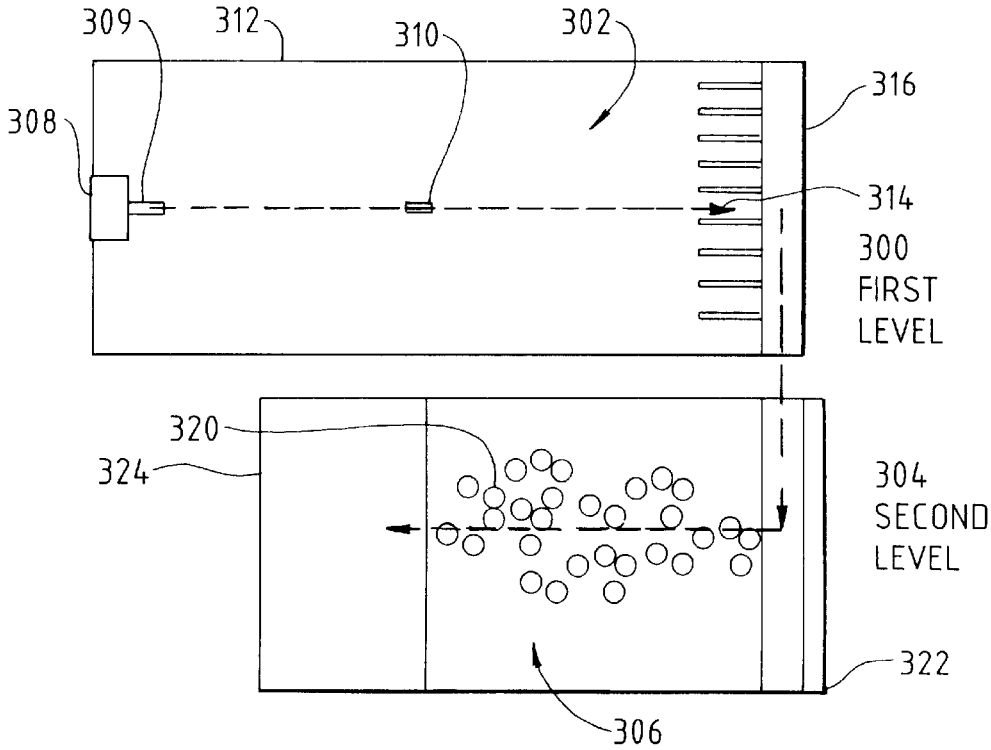
FIG. 4 is a top view of the FIG. 3 embodiment.

FIGS. 3 and 4 more clearly show the FIG. 2 embodiment. The gamepiece aiming device 308 has a shoot 309 via which a coin 310 is ejected onto a surface 312 of a first playfield 302. The coin 310 then enters a slot 314, which may or may not be a win. The coin is then conducted via a structure 316 to the second playfield 306, which is a coin pusher game. On the second playfield 306, pusher 322 pushes the coins 320 into receiving area 324. Each of the first and second playfields 302, 306 are independent games that reside in separate first and second levels, 300, 304, respectively. In the FIG. 2 embodiment, the surface 312 of the first playfield is glass so that a player can view the second playfield 306, which is located below the first playfield. Tickets or other rewards are dispensed after both playfields have been traversed by a coin. Thus a player can play multiple games with a single coin, each of the games or playfields having its own win/lose scenario. These win/lose scenarios can be independent of one another or, alternatively, playing a successive playfield can be dependent upon the win/lose scenario of a previous playfield.

Figure 5:
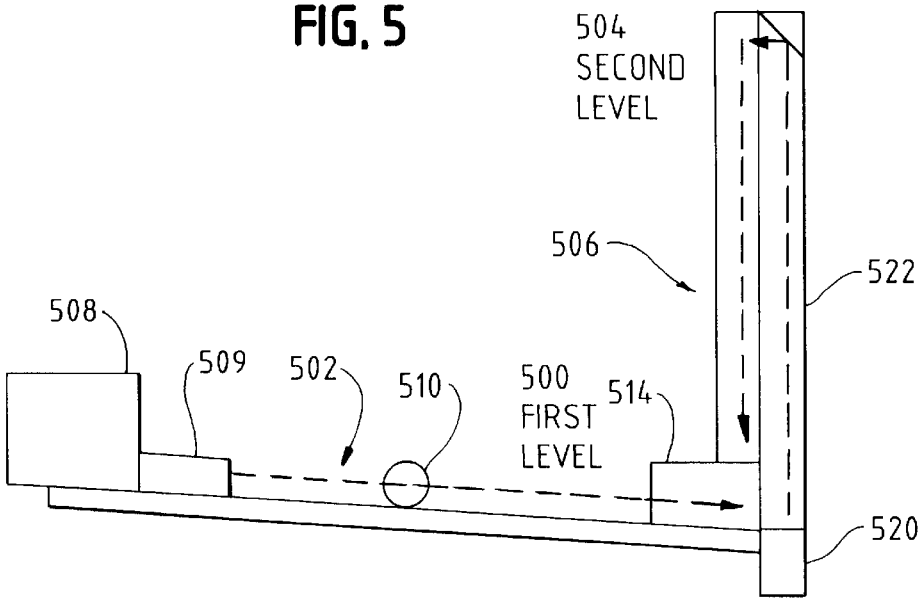
FIG. 5 is a side view of a diagram depicting the multiple levels of another embodiment of the inventive game apparatus.
Figure 6:
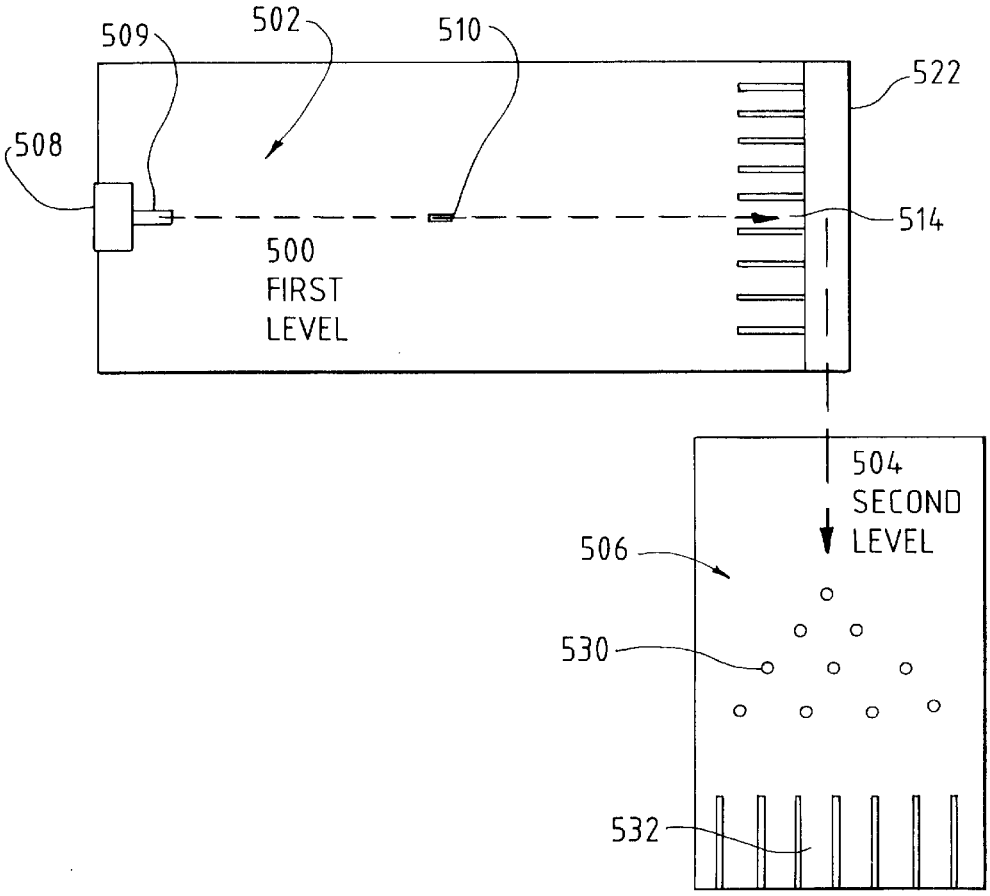
FIG. 6 is a top view of the FIG. 5 embodiment.

The second playfield need not be located below the first playfield. An alternative embodiment of the present invention is depicted in FIGS. 5 and 6. In this embodiment the second level 504 having a second playfield 506 is located above the first level 500 having a first playfield 502. Furthermore the second level 504 is substantially in a vertical orientation, whereas the first level 502 is substantially in a horizontal plane relative to one another.

Similar to the FIG. 3 embodiment, the gamepiece aiming device 508 has a shoot 509 via which a coin 510 is ejected onto the first playfield 502 in the first level 500. The shoot is adjustable so as to accommodate different size coins or tokens. Alternatively the shoot 509 can have a fixed configuration. The coin 510 then enters a slot 514, which may or may not be a win. The coin is then conducted via a solenoid 520 and structure 522 to the second playfield 506 in the second level 504, where obstacles 530 (FIG. 6) deflect the coin until it resides in one of the slots 532. Each of the first and second playfields 502, 506 are independent games that reside in first and second levels, 500, 504, respectively, and tickets or other rewards are dispensed after both playfields have been traversed by the coin. Thus a player can play multiple games with a single coin, each of the games or playfields having its own win/lose scenario.

Figure 7:
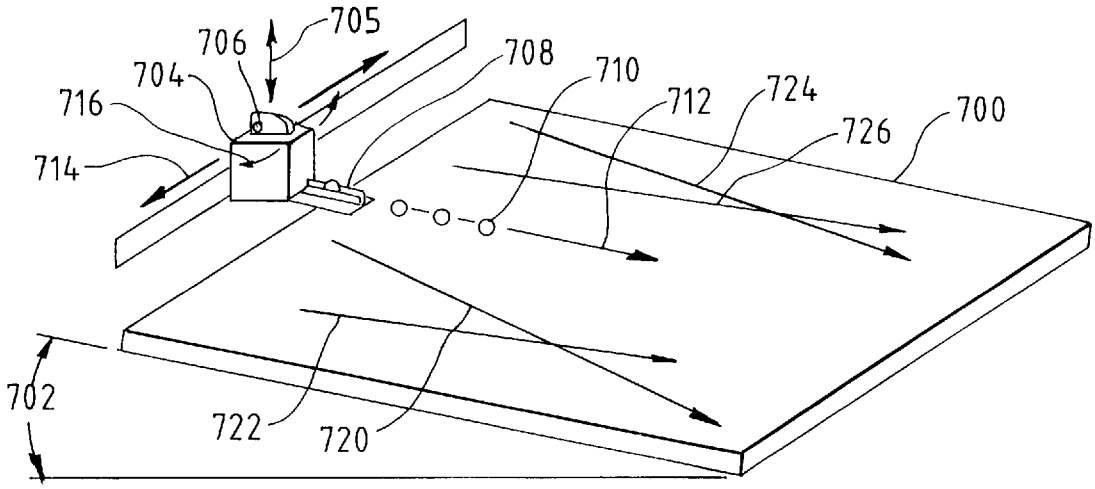
FIG. 7 depicts the gamepiece aiming device of the present invention.

The gamepiece aiming device uses more than one degree of movement allowing the player to have a higher degree of accuracy. As schematically depicted in FIG. 7 The gamepiece aiming device 704 has a gamepiece receiving mechanism 706 and a shoot 708 for ejecting coins 710 onto a playfield 700. The playfield 700 is inclined at an angle 702, for example about 22 degrees, so that the coins 710 will roll down the playfield 700. With the ability to move the gamepiece aiming device 704 side to side, as indicated by arrow 714, the player is able to line up the gamepiece aiming device with the target prior to inserting the coin. In addition the player is also allowed to pivot the gamepiece aiming device 704, as indicated by arrow 716, to make fine adjustments. For the operator, the coin mechanism also allows for player inaccuracy, therefore increasing the player challenge and level of difficulty. Depending upon the orientation of the gamepiece aiming device 704, the coins 710 will be directed along different paths such as paths 712, 720, 722, 724, 726, 726.

Figure 8:
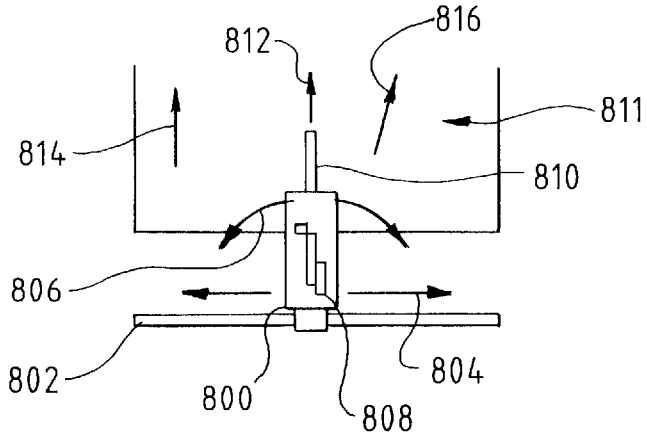
FIG. 8 is a top view of the FIG. 7 embodiment.

FIG. 8 is a top view of the gamepiece aiming device 800 with gamepiece receiving device 808 and shoot 810. The gamepiece aiming device moves linearly (first degree of movement) as indicated by arrow 804 along rail 802, and rotates (second degree of movement) as indicated by arrow 806. Coins can thus be ejected along different paths 812, 814, 816 on playfield 811. In one embodiment the linear first degree of movement is substantially perpendicular to a longitudinal axis on the first playfield. In a further embodiment the gamepiece aiming device 800 has a third degree of movement in a direction perpendicular to the direction of the first degree of movement. (See arrow 705 in FIG. 7.) Alternatively, the gamepiece aiming device 800 may have a swivel mechanism for effecting the plurality of degrees of movement.

In one embodiment, the gamepiece aiming device allows for most standard coin mechanisms to be inserted therein. This gives the ability for the operator to interchange different coin mechanisms. The coin mechanism is easily accessible, easily removed, and easily installed. Coin/token accepting mechanisms are well known in the prior art. One common type of standard coin mechanism measures 3" by 5", but is not useable in roll-down games. It is commonly used in most video and redemption games. The gamepiece aiming device of the present invention utilizes in one embodiment such a standard coin mechanism due in part to the use of the shoot described above. This is an advantage of the present invention over the prior art in that an operator/owner of the game can easily change from one size coin to another. The coin mechanism slides or is hinged, for example, into an interior of the gamepiece aiming device. Of course various other types of coin mechanisms can be used with the present invention. In this particular embodiment standard coin mechanisms (gamepiece receiving mechanisms) refer to the various coin/token acceptors that have the 3" by 5" configuration.

Figure 9:
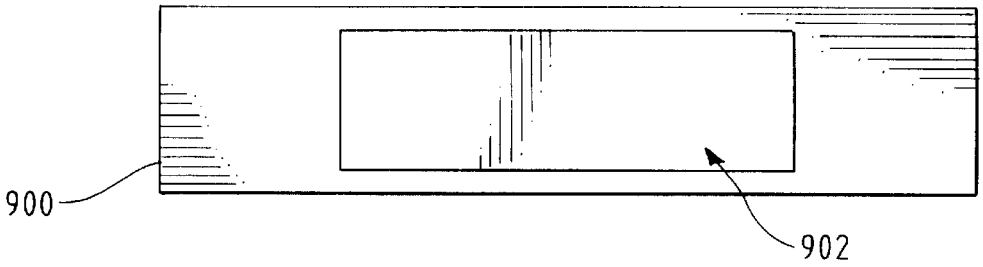
FIG. 9 depicts a cover of the gamepiece aiming device.
Figure 10:
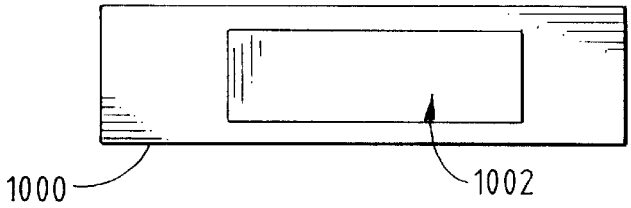
FIG. 10 depicts an internal tray of the gamepiece aiming device.
Figure 11:
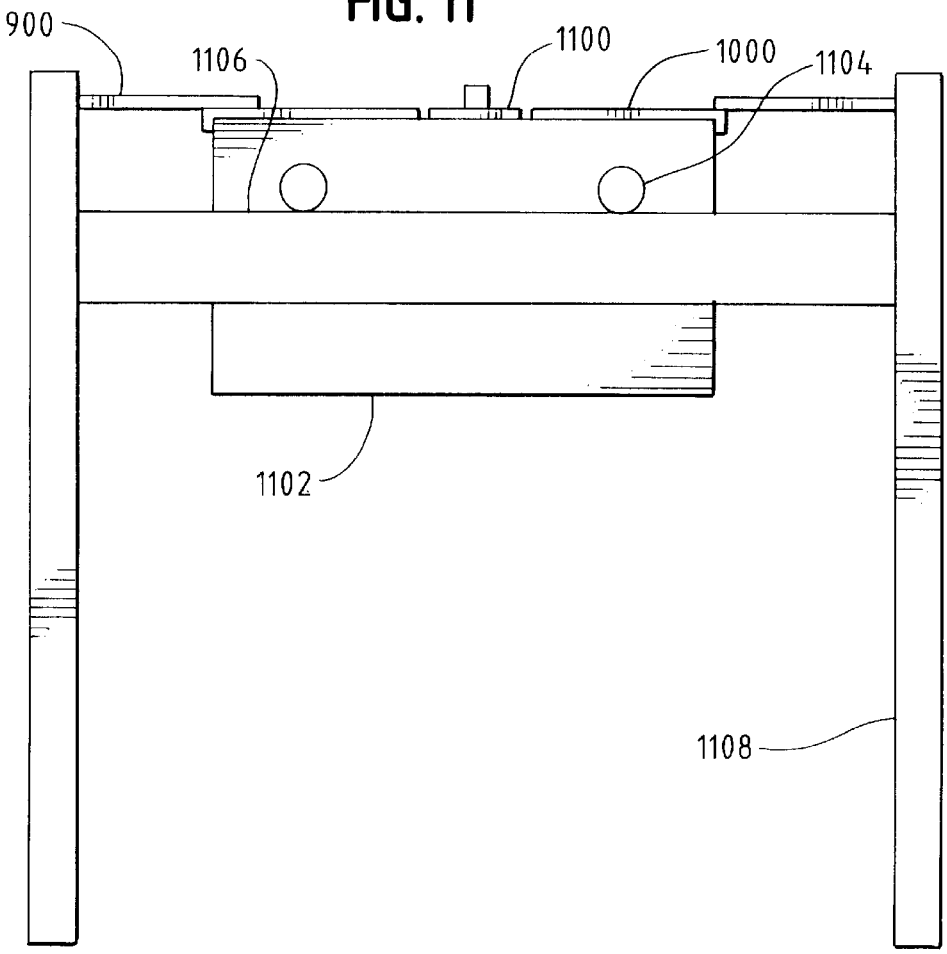
FIG. 11 depicts the components of the gamepiece aiming device.

As depicted in FIGS. 9, 10 and 11, the gamepiece aiming device has a carriage 1102 that contains the rail 1106 and bearing components 1104 that allow the side to side motion. The rail 1106 of the carriage 1102 is secured to the game cabinet 1108. The gamepiece aiming device also has an internal tray 1000 that sits unsecured on the top of the carriage 1102 and covers all exposed openings created by sliding movement. Placed on top of the carriage 1102, the internal tray 1000 is free moving within the area between the carriage 1102 and a cover 900. The cover 900 sits on top of the carriage 1102 and internal tray 1000. The cover 900 is secured to the game cabinet 1108 on either side. None of the three components 900, 1000, 1102 are secured to each other. Only the cover 900 and rail 1106 are secured to the cabinet 1108. Each of the cover 900 and tray 1000 has an opening 902, 1002 respectively for the gamepiece ejection device 1100.

Figure 12:
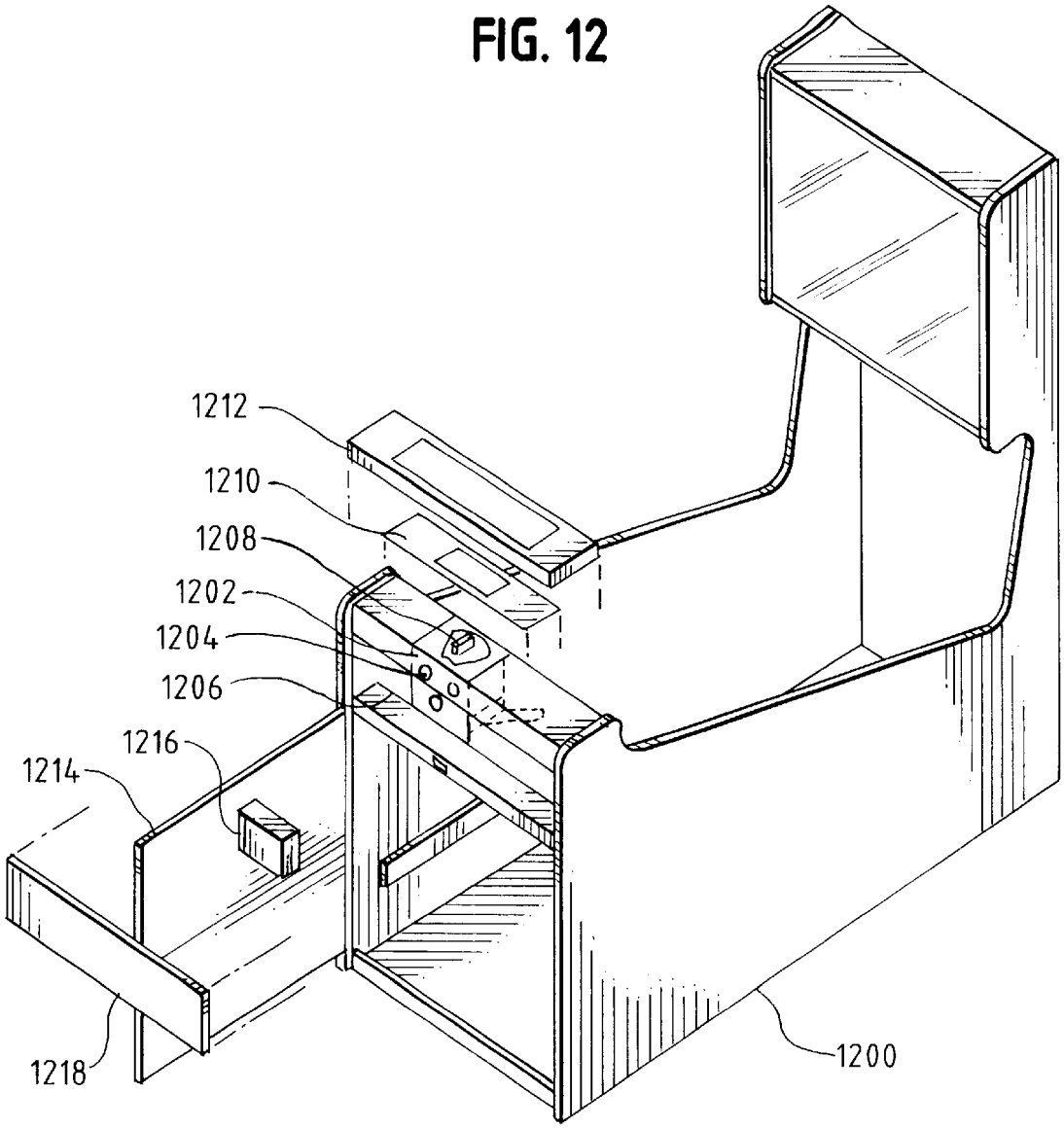
FIG. 12 is an exploded perspective view of the present invention illustrating the gamepiece aiming device.

The gamepiece aiming device is shown in an exploded view in FIG. 12. The gamepiece aiming device 1208 has carriage 1202 with rail 1206 and bearings 1204, internal tray 1210, and cover 1212. The rail 1206 and cover 1212 are secured to the cabinet 1200. A door 1214 of the cabinet 1200 has the redemption ticket dispenser 1216. A housing cover 1218 is attached to the front of the cabinet 1200.

Figure 13:
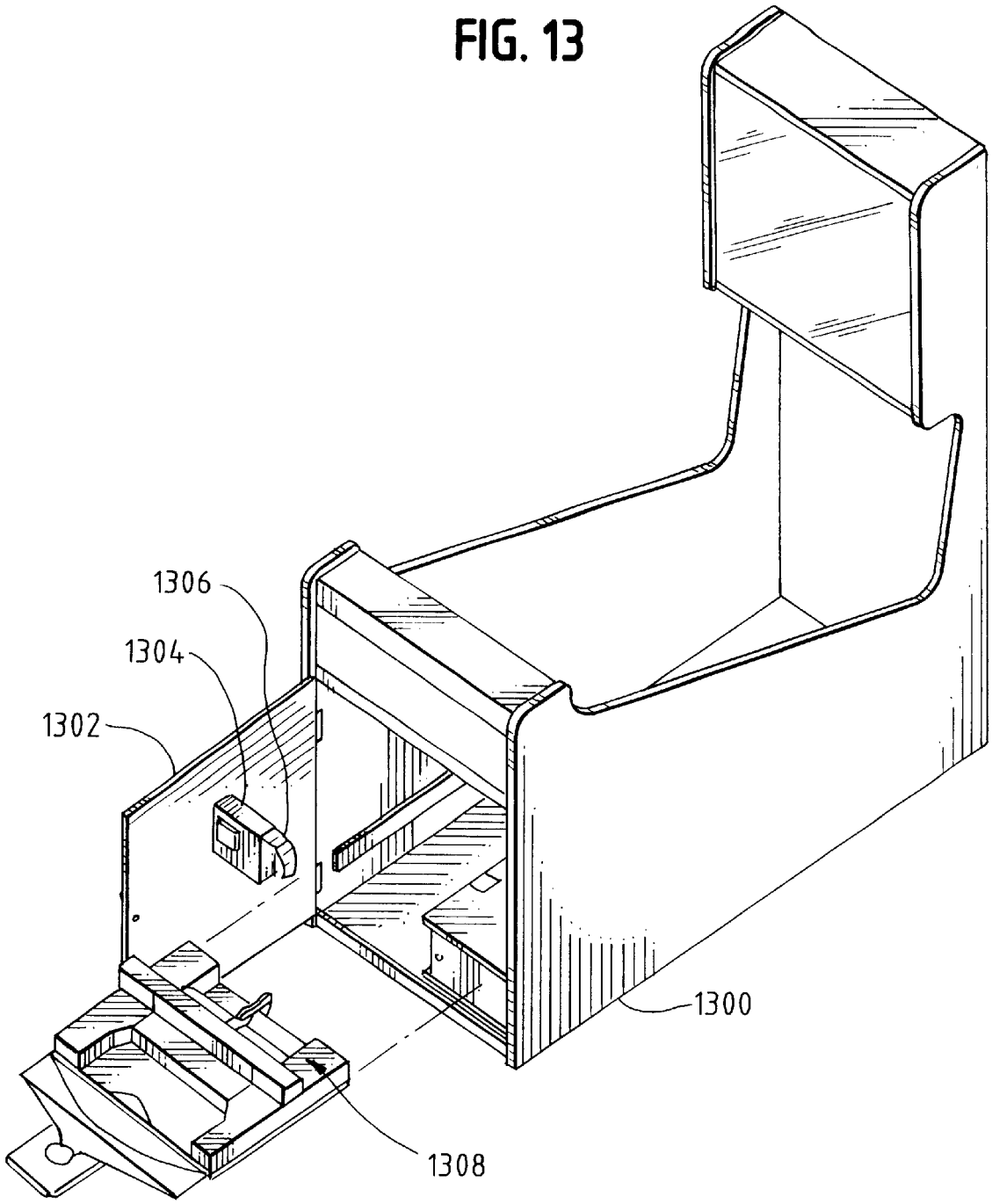
FIG. 13 is an exploded perspective view of the present invention illustrating the modular playfield concept.

The arcade game of the present invention can be easily transformed into a completely different game within minutes. The majority of the game cabinet 1300 (see FIG. 13) remains the same, but the internal components such as software, graphics, and specific game hardware are developed to be easily interchangeable. With the door 1302 that has the redemption dispenser 1304 and tickets 1306 in an open position, a modular playfield 1308 can be easily and quickly installed in the cabinet 1300. With the multi-playfield concept the purchaser/owner has the ability to combine any combination of games offered. If a purchaser/owner later decides to change the game after initial purchase, an upgrade kit can be offered. The cabinet assembly including the display boards, circuit board, coin mechanism, ticket mechanism, lighting, glass, cabinet, and other hardware remain the same. Thus the owner can continuously upgrade and change the game at a significantly lower cost than buying new games. In one embodiment the second playfield is replaceable whereas the first playfield is permanently secured to the game cabinet.

The invention is not limited to the particular details of the apparatus depicted and other modifications and applications are contemplated. For example, gamepieces of various shapes, such as balls, can be utilized with the present invention other than coins and tokens. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A game apparatus, comprising:

a gamepiece aiming device having a plurality of degrees of movement;

a multi-playfield game having at least first and second playfields that are coupled to one another; and the gamepiece aiming device emitting a gamepiece into the first playfield for first game play, the gamepiece thereafter being conducted to the second playfield for second game play.

2. The game apparatus according to claim 1, wherein the gamepiece is one of a coin and a token.

3. The game apparatus according to claim 1, wherein the gamepiece aiming device has a first degree of movement, of the plurality of degrees of movement, that is a substantially linear movement, and wherein the gamepiece aiming device has a second degree of movement, of the plurality of degrees of movement, that is a rotational movement.

4. The game apparatus according to claim 3, wherein the linear movement is substantially perpendicular to a longitudinal axis of at least the first playfield.

5. The game apparatus according to claim 3, wherein the gamepiece aiming device has a third degree of movement, of the plurality of degrees of movement, in a substantially vertical direction relative to the first degree of movement.

6. The game apparatus according to claim 1, wherein the playfield has a plurality of levels and, wherein the first and second playfields are in different levels of the plurality of levels.

7. The game apparatus according to claim 1, wherein the playfield has a plurality of playfields and a plurality of levels and, wherein at least one respective playfield is in each level of the plurality of levels.

8. The game apparatus according to claim 1, wherein the playfields have a modular configuration and, wherein at least some of the playfields are interchangeable with one another.

9. The game apparatus according to claim 1, wherein the playfields are traversed by the gamepiece in a predetermined sequence.

10. The game apparatus according to claim 1, wherein each playfield has a win/lose scenario, and wherein the win/lose scenarios are independent of one another.

11. A multilevel game apparatus, comprising:

a gamepiece aiming device having a gamepiece ejection device configure to have at least a rotational movement, and a carriage that supports the gamepiece ejection device, the carriage configured to have a linear movement;

a multi-playfield game having at least first and second levels, and having at least first and second playfields that are coupled to one another, the first playfield located in the first level and the second playfield located in the second level; and the gamepiece aiming device emitting a gamepiece into the first playfield for first game play, the gamepiece thereafter being conducted to the second playfield for second game play.

12. The game apparatus according to claim 11, wherein the gamepiece is one of a coin and a token.

13. The game apparatus according to claim 11, wherein each playfield has a win/lose scenario, and wherein the win/lose scenarios are independent of one another.

14. The game apparatus according to claim 11, wherein the game ejection device has a gamepiece receiving mechanism and an adjustable shoot that is adaptable to gamepieces having different configurations, wherein the gamepiece aiming device has an internal tray that substantially covers the carriage and that has an opening for the game ejection device; and wherein the gamepiece aiming device further has a cover over the internal tray, the cover having an opening for the game ejection device.

15. A game apparatus, comprising:

a multi-playfield game having a plurality of playfields, each of the playfields being successively traversed by a gamepiece, and each playfield of the plurality of playfields having a respective win/lose scenario;

a gamepiece aiming device having a plurality of degrees of movement, the gamepiece aiming device emitting a gamepiece into the first playfield for game play;

each playfield of the plurality of playfields coupled to a following playfield of the plurality of playfields except for a last playfield of the plurality of playfields; and wherein each playfield has a respective win/lose scenario, and wherein each playfield is played irrespective of an outcome of a win/lose scenario of a previous playfield.

16. The game apparatus according to claim 15, wherein the gamepiece is one of a coin and a token.

17. The game apparatus according to claim 15, wherein the gamepiece aiming device has a first degree of movement, of the plurality of degrees of movement, that is a substantially linear movement, and wherein the gamepiece aiming device has a second degree of movement, of the plurality of degrees of movement, that is a rotational movement.

18. The game apparatus according to claim 17, wherein the linear movement is substantially perpendicular to a longitudinal axis of at least the first playfield.

19. The game apparatus according to claim 17, wherein the gamepiece aiming device has a third degree of movement of the plurality of degrees of movement in a substantially vertical direction relative to the first degree of movement.

20. The game apparatus according to claim 15, wherein the game apparatus further comprises a plurality of levels and, wherein the respective playfields are in different levels of the plurality of levels.

21. The game apparatus according to claim 20, wherein the playfields are traversed sequentially by the gamepiece.

22. The game apparatus according to claim 21, wherein the playfields have a modular configuration and, wherein at least some of the playfields are interchangeable with one another.

23. A game system, comprising:

a plurality of modular playfields;

a multi-playfield game that has removeably coupled thereto a number of playfields that is a subset of the plurality of modular playfields, each of the playfields in the game device being successively traversed by a gamepiece, and each of the playfields in the game device having a respective win/lose scenario;

a gamepiece aiming device having at least first and second degrees of movement, the gamepiece aiming device emitting a gamepiece into a first playfield in the game device for game play;

each playfield in the game device coupled to a following playfield in the game device except for a last playfield in the game device; and wherein each playfield in the game device is played irrespective of an outcome of a win/lose scenario of a previous playfield, and wherein playfields in the game device are interchangeable with other playfields of the plurality of modular playfields.

24. The game apparatus according to claim 23, wherein the gamepiece is one of a coin and a token.

25. The game apparatus according to claim 23, wherein the game device has a first level having a first playfield and a second level having a second playfield, and wherein the second playfield is interchangeable with other playfields of the plurality of modular playfields, and wherein the first playfield is permanently installed in the game apparatus.

26. The game apparatus according to claim 23, wherein the game device has a plurality of levels and, wherein at least one respective playfield is in each level of the plurality of levels.

27. A game apparatus, comprising:

a gamepiece aiming device having a plurality of degrees of movement, and a removable gamepiece receiving mechanism that receives gamepieces;

a multi-playfield game having at least first and second playfields that are coupled to one another; and the gamepiece aiming device emitting a gamepiece into the first playfield for first game play, the gamepiece thereafter being conducted to the second playfield for second game play.

28. The game apparatus according to claim 27, wherein the gamepiece is one of a coin and a token.

29. The game apparatus according to claim 27, wherein the gamepiece receiving mechanism is interchangeable with a plurality of other gamepiece receiving mechanisms.

30. The game apparatus according to claim 27, wherein the gamepiece receiving mechanism is one of a plurality of standard gamepiece receiving mechanisms.

* * * * *